US005853312A

United States Patent [19]

Li

[11] Patent Number: 5,853,312

[45] Date of Patent: Dec. 29, 1998

[54] MODEL AIRPLANE FOR SCIENTIFIC EDUCATION AND COMPETITION

[75] Inventor: Danny H. Y. Li, West, Hong Kong

[73] Assignee: Lyon Aviation Engineering Equipment Co., Ltd., Hong Kong, Hong Kong

[21] Appl. No.: 597,276

[22] Filed: Feb. 6, 1996

[30] Foreign Application Priority Data

Sep. 15, 1995 [CN] China ..... 95 2 21641.8

[51] Int. Cl.[6] ..... A63H 27/18

[52] U.S. Cl. ..... 446/61; 446/66; 446/88; 244/16

[58] Field of Search ..... 446/61, 63, 64, 446/66, 67, 68, 88; 244/16, 48, 131

[56] References Cited

U.S. PATENT DOCUMENTS

| | | | |
|---|---|---|---|
| 1,792,779 | 2/1931 | Tarr | 446/66 |
| 2,555,670 | 6/1951 | Babcock | 446/88 |
| 2,870,569 | 1/1959 | Bergstrand | 446/68 |
| 3,369,319 | 2/1968 | Brown | 446/64 |
| 4,203,250 | 5/1980 | Garofalo | 446/61 |
| 4,655,720 | 4/1987 | Renger et al. | 446/61 |
| 4,957,465 | 9/1990 | Dasa | 446/61 |
| 5,007,875 | 4/1991 | Dasa | 446/68 |

FOREIGN PATENT DOCUMENTS

| | | | |
|---|---|---|---|
| 1051368 | 12/1966 | United Kingdom | 446/61 |

*Primary Examiner*—Robert A. Hafer
*Assistant Examiner*—Laura Fossum
*Attorney, Agent, or Firm*—Merchant, Gould, Smith, Edell, Welter & Schmidt

[57] ABSTRACT

The present invention relates to an improved model airplane for purposes of scientific education and competition. Model airplanes in the prior art are either bad at flying, or do not look like real airplanes; and all are short of a collision prevention device. By means of some special positioning adapters for fixing the wing section firmly to the body and by adding a collision buffer piece to the nose, the model airplane according to the present invention is not only good at flying, but also safe and durable to use. The model airplane according to this invention is, therefore, best suitable for the above-mentioned purposes.

3 Claims, 4 Drawing Sheets

FIG. 1A
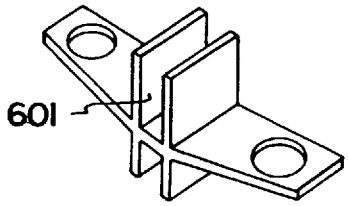
FIG. 1B
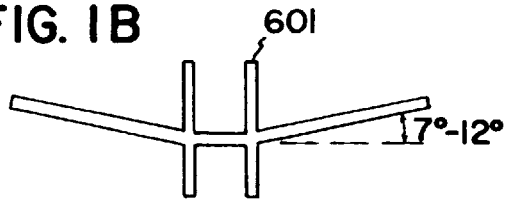
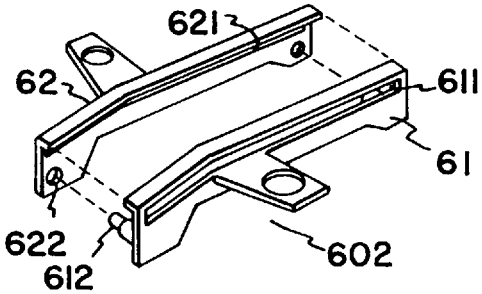
FIG. 1C
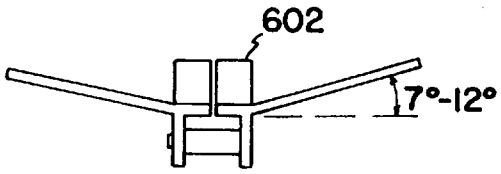
FIG. 1D
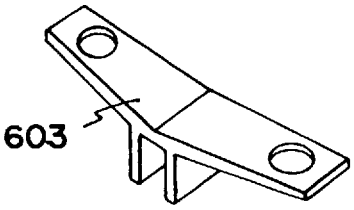
FIG. 1E
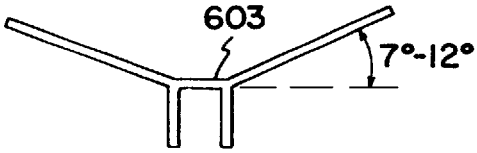
FIG. 1F
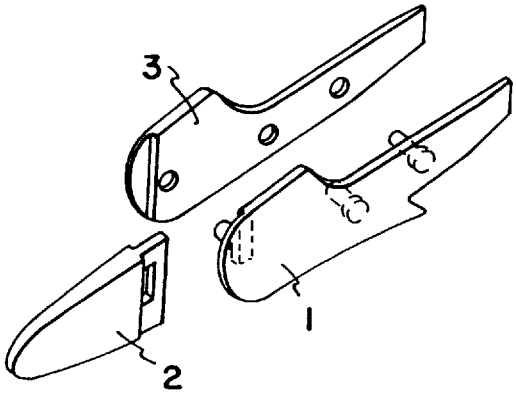
FIG. 2A
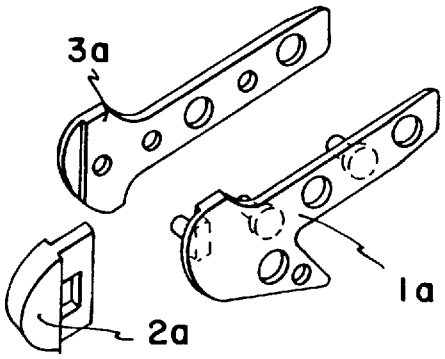
FIG. 2B

MODEL AIRPLANE FOR SCIENTIFIC EDUCATION AND COMPETITION

BACKGROUND OF THE INVENTION

1. Field of the Invention

The present invention relates to model airplanes, in particular to model airplanes used for scientific education and competition.

2. Description of Related Art

In the contemporary world, there are many kinds of model airplanes used in scientific education and sports competition. However, simple model airplanes for primary scientific education purposes usually fly either poorly or not at all, and simple model airplanes used for competition often do not look like real airplanes. In addition, none of the prior art model airplanes have collision buffer devices, nor adapters for positioning the wing section firmly to the body. They are, therefore, not at all good at flying and unsafe in use.

OBJECT OF THE INVENTION

It is, therefore, an object of the present invention to provide a model airplane for educational and competition purposes having a special adapter to fix the wing section firmly to the body so as to improve the ability to fly; another object is to provide a model airplane which has a collision buffer device, looks like a real airplane, and is easy to make, requiring no special materials.

BRIEF DESCRIPTION OF THE DRAWINGS

The above advantages, as well as others, of the present invention will be clearly seen according to the description below, with reference to the attached drawings, wherein:

FIGS. 1*a*–1*f* illustrate three different positioning adapters for fixing the wing section to the body according to the present invention.

FIGS. 2*a* and 2*b* illustrate parts related to the nose of the model airplane according to the present invention;

DESCRIPTION OF THE INVENTION

As is common knowledge, a model airplane comprises a nose, a body, a wing section, and a tail having tailpieces. The above first-mentioned object of the present invention can be realized by providing different special adapters, as is described hereinbelow, for properly fixing the wing section to the body for different model airplanes, including models having low wing, middle wing, shoulder wing, or high wing designs. The wing sections are mounted onto the body by means of mortise and tenon joints or mounting slots. The tail pieces are mounted in a similar manner.

The model airplane according to the present invention includes a body consisting of a nose, a tail, a vertical tailpiece, a wing section, an adapter for fixing the wing section to the body, a horizontal tailpiece, and a collision buffer piece fitted to the nose. The body, the wing section and the tail pieces, are made of similar or different materials and have exactly the same shape and outlook as those for a real airplane. The buffer piece is made of soft rubber, and is fitted to the nose of said body by two fixing plates, one of which has tenons to go through holes in the nose and the buffer piece into corresponding mortises in the other plate. The first fixing plate is additionally provided with a hook for catapulting the model airplane. Thus a model airplane, as above described, apparently has all the afore-mentioned advantages, as compared with those in the prior art. When assembled, the nose is well balanced by the weight of the buffer piece, while the fixing plates thereof at the same time provide a hook for catapulting the model airplane.

First Embodiment

Figure 3A:
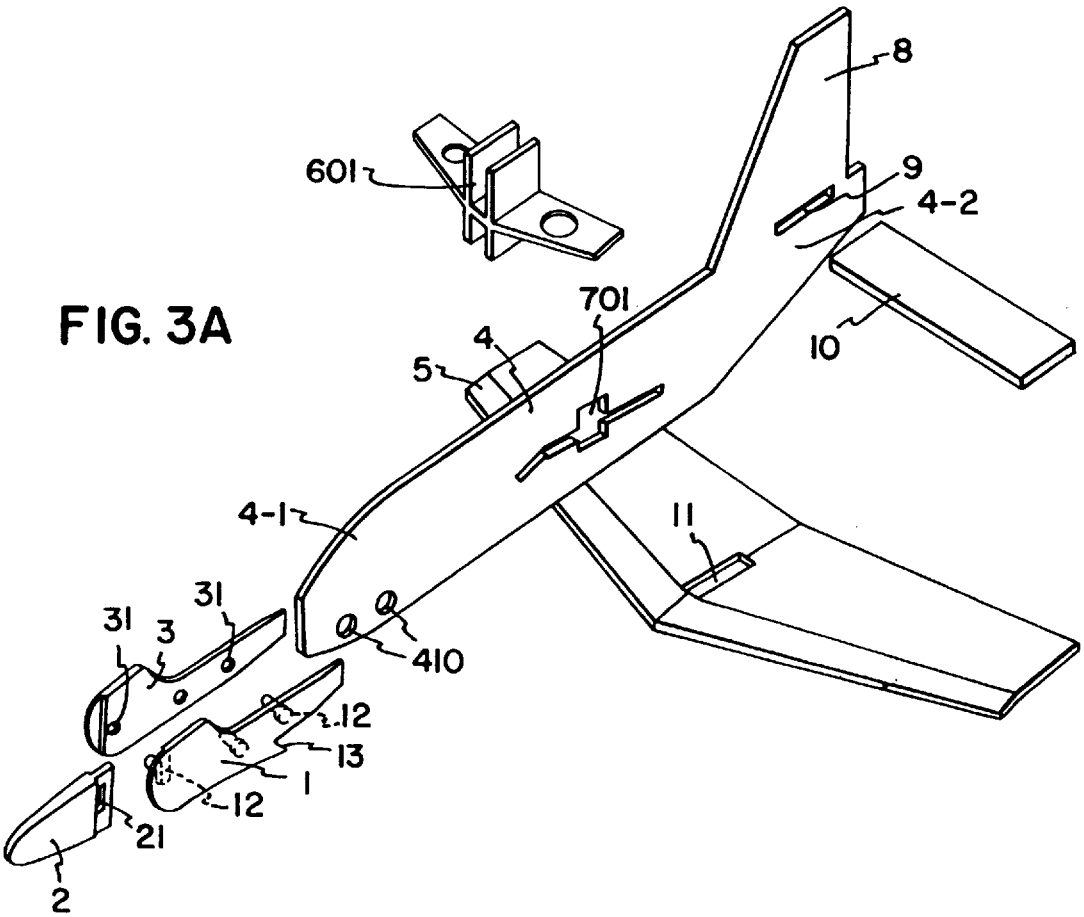
FIG. 3*a* and 3*b* respectively show a perspective view and an exploded view of a first embodiment of the invention.
Figure 3B:
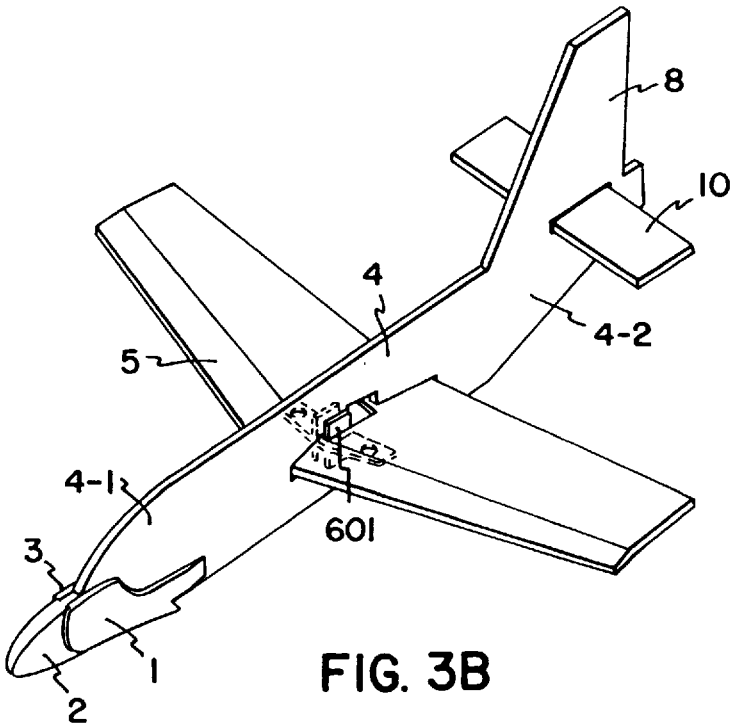

Referring to FIGS. 1*a*, 1*b*, 2*a*, 3*a* and 3*b*, the first embodiment of the present invention comprises an airplane body 4 having a nose 4-1 section and a tail section 4-2, with a vertical tail piece 8. The airplane includes a wing section 5, and an adapter 601 for fixing said wing section 5 to said body 4, a horizontal tail piece 10 fitted into said tail 4-2 through a slot 9 therein, and a buffer piece 2, fixed to the nose by two fixing plates 1 and 3, wherein plate 1 is provided with tenons 12 to go through holes 410 in said nose 4-1, hole 21 in said buffer piece 2 to fit into corresponding mortises 31 in said plate 3; and said fixing plate 1 is, in addition, provided with a hook 13 for catapulting the model airplane of the present invention. Also illustrated in FIG. 2*b* is an alternative embodiment of the left fixing plate, 1*a*, the right fixing plate, 3*a* and buffer piece, 2*a*. FIG. 1*b* illustrates the cross-sectional shape of the first adapter 601, whose upper slotted portion and lower slotted portion fit into a square hole 701 in the middle of said body 4, while the middle portion of the adapter fits into a locating slot 11 in the middle of said wing section 5. With the first adapter 601 in place, said wing section 5 is prevented from moving leftward or rightward. The first adapter 601 preferably has an elevation (dihedral) angle of 0°–20°, and more preferably 7°–12° as shown, thus supporting the right and left halves of said wing section 5 to maintain such an elevation angle. Said first adapter 601 has an additional function of strengthening the root portion of said wing section 5, besides fixing the wing section to the body and keeping the wing section raised at the above-said elevation angle. A first adapter 601 of this design is suited for use in models of the middle wing or lower wing design.

Second Embodiment

Figure 4A:
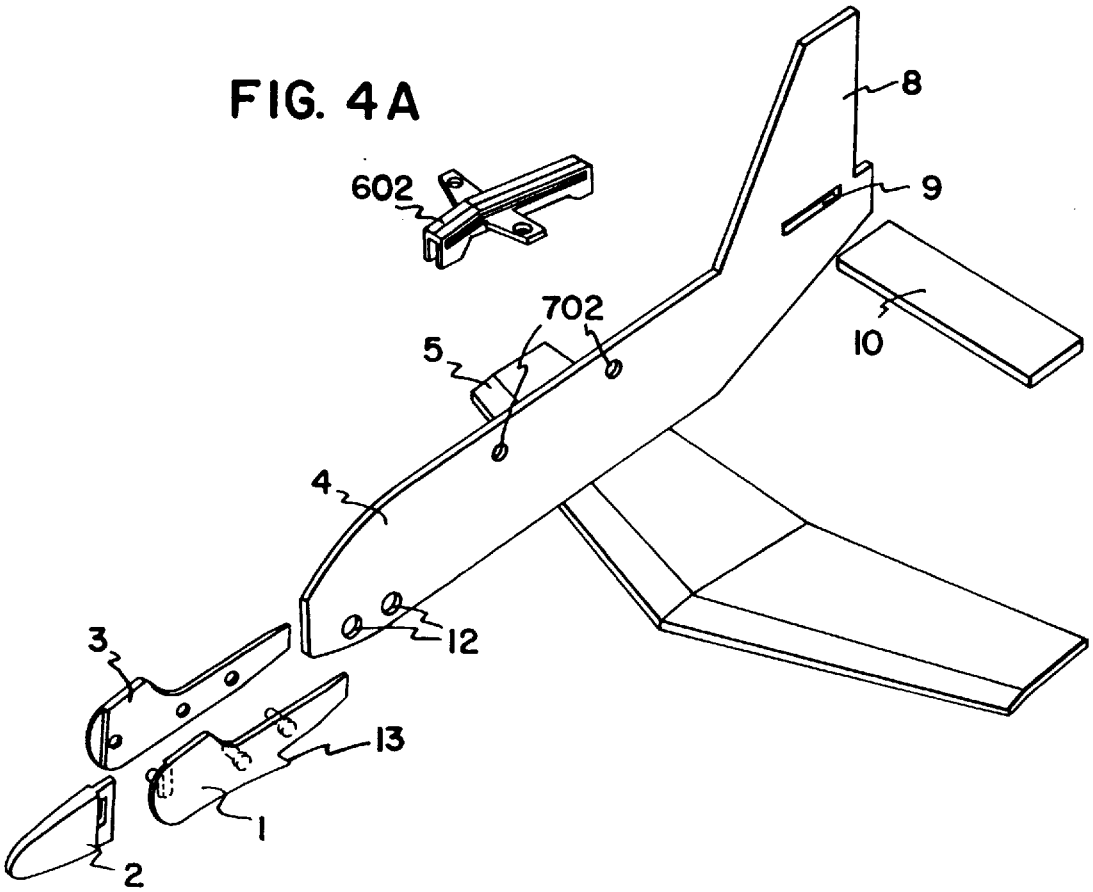
FIG. 4*a* and 4*b* respectively show a perspective view and an exploded view of a second embodiment of the invention.
Figure 4B:
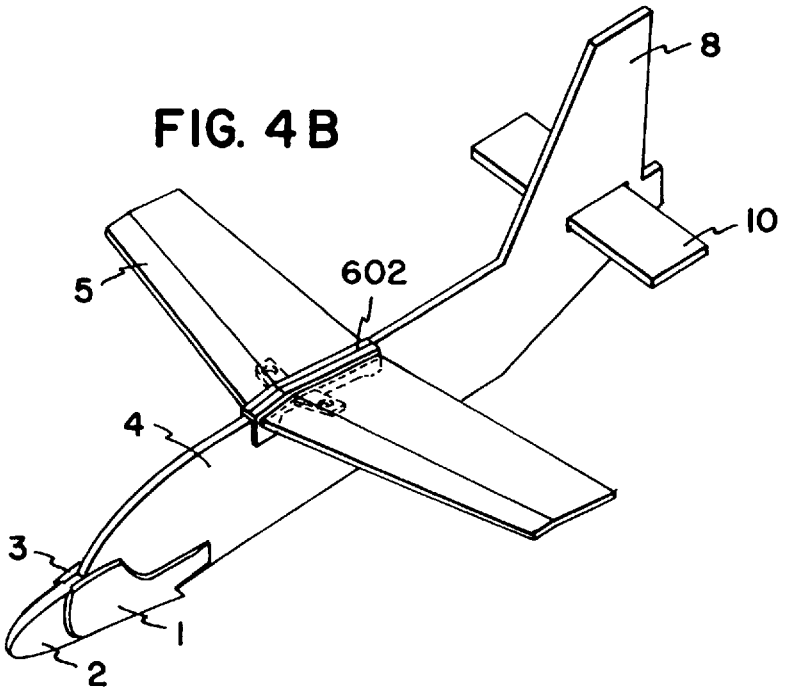

The second embodiment is described in reference to FIGS. 1*c*, 1*d*, 2*a*, 4*a*, and 4*b*. In this embodiment, a second adapter 602 is used, said second adapter 602 having a left portion 61 and a right portion 62. For the second adapter 602, the wing section 5 does not have a locating slot in its middle, nor is there a square hole in the middle of the body. In the second embodiment, the wing section 5 goes through a slot 611 in said left portion 61 and another slot 621 in said right portion 62, while said left portion 61 has tenons 612 to go through holes 702 in the middle portion of said body 4 and to fit into corresponding mortises 622 in said right portion 62, thus fixing said wing section 5 to said body 4. The second adaptor 602 preferably has an elevation angle in the range 0°–20°, and more preferably 7°–12° as shown, thus maintaining the elevation angle of the wing section 5 in the same range. The second adapter 602 is suited for use in shoulder-wing models.

Third Embodiment

Figure 5A:
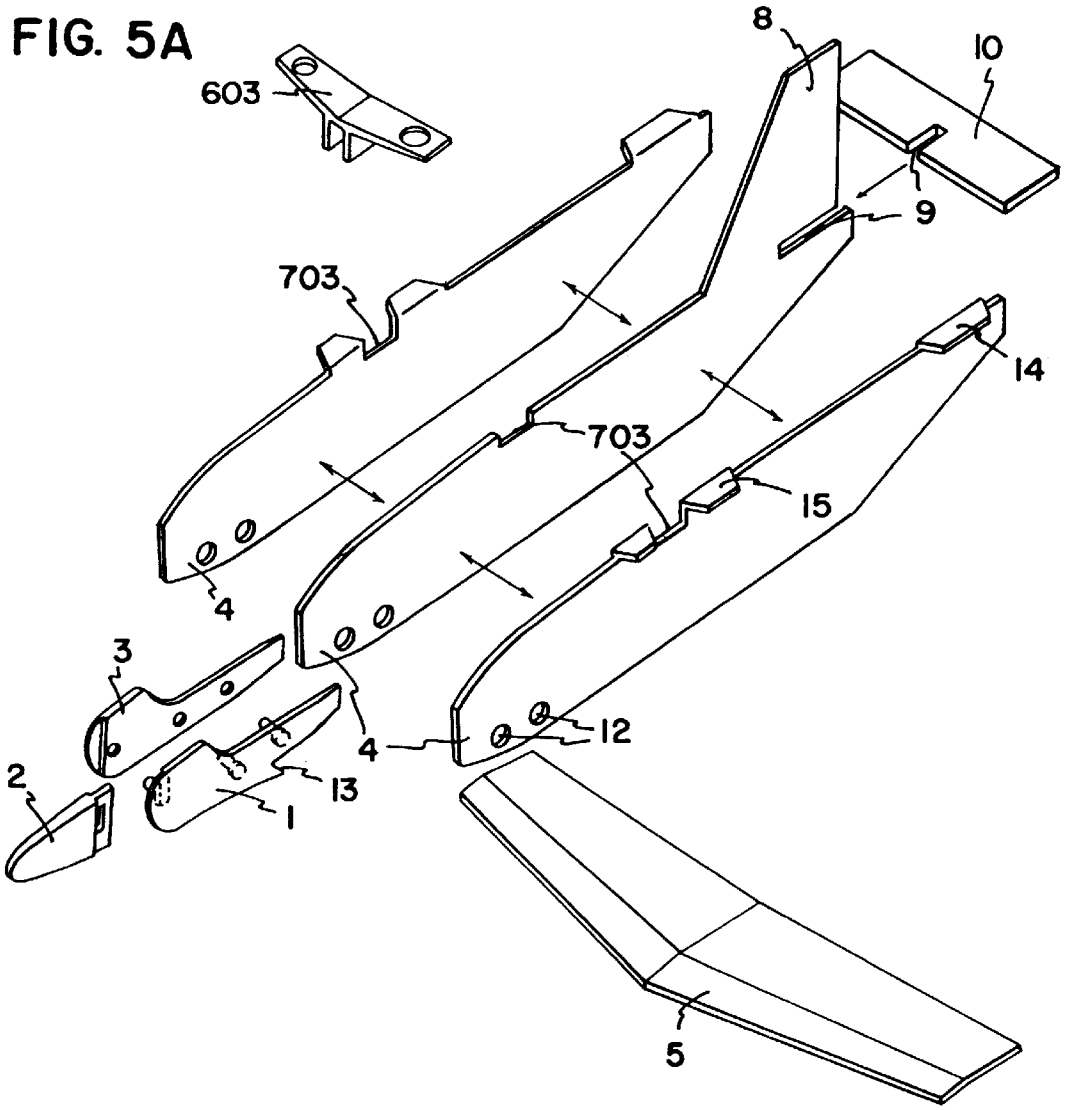
FIG. 5*a* and 5*b* respectively show a perspective view and an exploded view of a third embodiment of the invention.
Figure 5B:
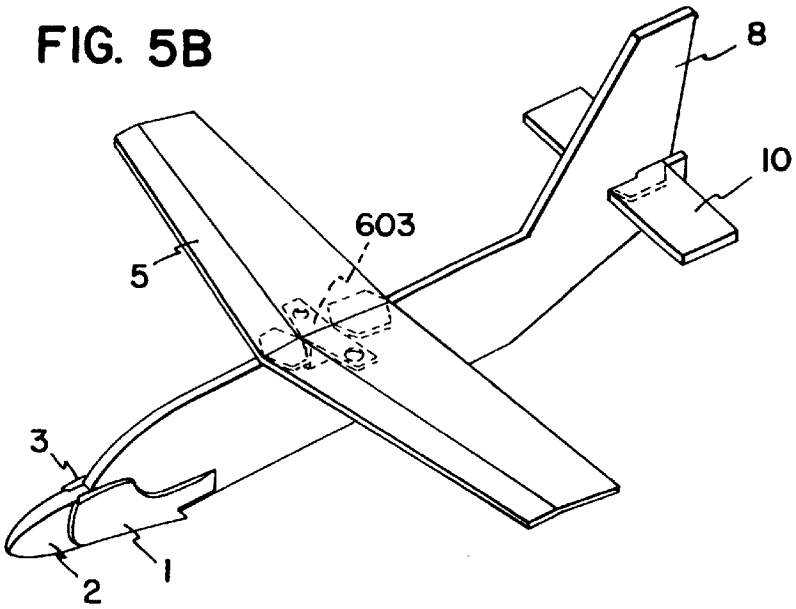

The third embodiment is described in reference to FIGS. 1*e*, 1*f*, 2*a*, 5*a* and 5*b*. In this embodiment, a third adapter 603 is used. In the third embodiment, the model airplane has a body 4 made from three or more pieces stuck together, which could be of the same or different material(s), with the outermost left and right pieces having out-turned wing section tabs 15 for sticking a wing section 5 to said body, and out-turned tail tabs 14 for sticking a horizontal tail piece 10 which has a slot 9 to fit into a corresponding slot in a vertical tail piece 8. A third adapter 603 is provided for the third embodiment, the third adapter being slotted and fitting into a mounting slot 703 in said body 4, to support said wing section 5 which is stuck to said tabs 15. The third adapter 603 also has sides preferably raised at an elevation angle in the range 0°–20°, and more preferably 7°–12° as shown. The third adapter 603 is illustrated in FIGS. 1*e* and 1*f* in an elevational view and a cross-sectional view.

In summary, the model airplane according to the present invention has the following advantages:

1) The nose portion is elaborately designed to be of a simple and compact structure, such that when assembled, said nose functions well for weight balance, keeping the centre of gravity of the model as a whole at a best position, while simultaneously serving as a buffer and providing a hook for catapulting. Thus the model airplane can be used more safely and durably.

2) A special adapter is provided for easy fixing of the wing section to the body, for strengthening the root portion of the wing section, and for keeping the wing section raised at an elevation angle, which is necessary for maintaining crosswise balance during flight.

3) Different adapters are provided to suit the need of different models.

4) Model airplanes according to the present invention can all be manufactured in a technologically simple process.

It will, of course, be understood that various modifications and additions can be made to the preferred embodiments discussed hereinabove without departing from the scope or spirit of the present invention. Accordingly, the scope of the present invention should not be limited by the particular embodiments listed above, but should be defined only by the claims set forth below and equivalents of the disclosed embodiments.

What is claimed is:

1. A model airplane, comprising:

a body having a nose portion and a tail portion, said nose portion being fitted with a detachable buffer and a hook, the tail portion having a vertical tail piece;

a wing section;

a horizontal tail piece fitted to said tail portion;

an adapter for holding said wing section to said body, said adapter being formed to raise the wing section at an elevation angle in the range 0°–20° with respect to a horizontal plane that is perpendicular to the body, and wherein said adapter comprises a left portion and a right portion, said left portion having tenons to go through holes in a central portion of said body and to fit into corresponding mortises in said right portion, said left portion and said right portion each having a slot for receiving said wing section, and the adapter having right and left sides elevated at an angle in the range of 0°–20° with respect to a horizontal plane that is perpendicular to the body.

2. A model airplane, as claimed in claim 1, wherein said detachable buffer comprises a first fixing plate, a second fixing plate and a buffer piece, said first fixing plate being provided with tenons to go through holes in said nose portion and a hole in said buffer piece, for fitting into corresponding mortises in said second fixing plate; said first fixing plate being provided with said hook.

3. A model airplane, as claimed in claim 1, wherein said elevation angle of the wing section is in the range of 7° to 12° with respect to a horizontal plane that is perpendicular to the body.

* * * * *